US008607709B2

(12) United States Patent
Lee et al.

(10) Patent No.: US 8,607,709 B2
(45) Date of Patent: Dec. 17, 2013

(54) INTERSECTION NAVIGATION SYSTEM

(75) Inventors: Young Hoon Lee, Seongnam-si (KR); Sung Hak Kim, Seoul (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 469 days.

(21) Appl. No.: 12/801,497

(22) Filed: Jun. 11, 2010

(65) Prior Publication Data

US 2011/0006026 A1 Jan. 13, 2011

(30) Foreign Application Priority Data

Jul. 13, 2009 (KR) ..... 10-2009-0063385

(51) Int. Cl.
*B61B 12/02* (2006.01)
*B61B 3/00* (2006.01)
*E01B 25/26* (2006.01)

(52) U.S. Cl.
USPC ..... 104/96; 104/105

(58) Field of Classification Search
USPC ..... 104/89, 93, 94, 95, 96, 98, 104, 105, 104/141, 122; 105/154, 155, 148; 212/71
See application file for complete search history.

(56) References Cited

U.S. PATENT DOCUMENTS

| | | | | | |
|---|---|---|---|---|---|
| 1,760,150 | A * | 5/1930 | Lawrence | ..... | 104/126 |
| 3,707,921 | A * | 1/1973 | Fort | ..... | 104/99 |
| 4,892,203 | A * | 1/1990 | Arav | ..... | 212/331 |
| 5,295,281 | A * | 3/1994 | Kordes | ..... | 16/95 R |
| 5,542,149 | A * | 8/1996 | Yu | ..... | 16/87.4 R |
| 7,467,723 | B2 * | 12/2008 | Zaguroli, Jr. | ..... | 212/331 |

* cited by examiner

*Primary Examiner* — Mark Le
(74) *Attorney, Agent, or Firm* — Harness, Dickey, & Pierce, P.L.C.

(57) ABSTRACT

An intersection navigation system for a hoist to prevent a hoist unit of the hoist from falling when the hoist unit passes an intersection may include a hoist unit including an auxiliary mover and a railway on which the hoist unit travels. The railway may include an intersection having auxiliary rails on which the auxiliary mover moves. Furthermore, the auxiliary mover may be configured to prevent the hoist unit from falling when the hoist unit passes through the intersection.

15 Claims, 13 Drawing Sheets

INTERSECTION NAVIGATION SYSTEM

CROSS-REFERENCE TO RELATED APPLICATION

This application claims priority under 35 U.S.C. §119 to Korean Patent Application No. 2009-0063385, filed on Jul. 13, 2009 in the Korean Intellectual Property Office (KIPO), the entire contents of which are herein incorporated by reference.

BACKGROUND

1. Field

Example embodiments relate to an intersection navigation system for a hoist to prevent a mover of a hoist unit from falling when the hoist unit passes an intersection.

2. Description of the Related Art

"Hoists" generally refer to devices that lift and transport articles. Hoists are used for transportation of freight in, e.g., storehouses and railroad stations, or for assembly and disassembly of machines in factories. In addition, hoists are used for transfer of semiconductor materials.

In the case of a ceiling traveling type hoist, rails on which the hoist will move are mounted to the ceiling, and a mover of the hoist moves along the rails to transport an article.

The hoist includes the mover to move on the rails upon receiving drive force, and a gripper to lift the article.

To change a movement direction during forward movement on the rails, the hoist uses branch rails diverged from a progress direction thereof. Selecting whether the hoist will move in the progress direction or in the diverged direction may be realized by changing a position of a divergence wheel provided at an upper end of the mover of the hoist.

However, using only the branch rails may cause an extended movement path from a starting position to a target position, resulting in inefficient operation of the hoist. That is, changing the movement direction of the hoist using the branch rails may result in long distance movement of the hoist in a roundabout way.

SUMMARY

Example embodiments provide an intersection navigation system wherein configurations of a railway and a hoist unit are improved to achieve efficient traveling at an intersection.

Example embodiments will be set forth in part in the description which follows and, in part, will be obvious from the description, or may be learned by practice of example embodiments.

In accordance with example embodiments, an intersection navigation system may include a hoist unit including an auxiliary mover and a railway on which the hoist unit travels. In example embodiments, the railway may include an intersection having auxiliary rails on which the auxiliary mover moves. Furthermore, in example embodiments, the auxiliary mover may be configured to prevent the hoist unit from falling when the hoist unit passes through the intersection.

In accordance with example embodiments, an intersection navigation system may include a railway having an intersection, and a hoist unit to move on the railway, wherein the intersection and the hoist unit include an intersection auxiliary structure to assist the hoist unit to smoothly pass the intersection.

In accordance example embodiments, an intersection navigation system may include a hoist unit to transport an article, and a railway having an intersection on which the hoist unit travels. The hoist unit may include an auxiliary mover to prevent the hoist unit from falling when the hoist unit passes the intersection, and the intersection may include auxiliary rails on which the auxiliary mover moves.

The railway may include a plurality of straight rails to permit rectilinear traveling of the hoist unit and intersection connectors to connect the respective straight rails to one another at the intersection, and the auxiliary rails may be coupled to inner sides of the respective intersection connectors.

The hoist unit may include a gripper to grip the article, and a mover coupled to the gripper so as to move along the railway, and the auxiliary mover may be arranged in a movement direction of the mover.

The mover may include a mover frame defining a framework of the mover, and driving wheels coupled to the mover frame to drive the mover, and the auxiliary mover may include an auxiliary mover frame defining a framework of the auxiliary mover, and auxiliary wheels coupled to the auxiliary mover frame so as to be rotated in contact with the auxiliary rails.

A distance between a rotation center of the auxiliary wheel and a rotation center of the driving wheel may be greater than a distance between each auxiliary rail and the intersection connector facing the auxiliary rail.

A distance between the auxiliary wheels may be smaller than a distance between the opposite straight rails and between the neighboring intersection connectors.

The intersection connectors may be arranged at respective corners of the intersection, and the auxiliary rails may be arranged lower than the intersection connectors.

The auxiliary wheels may be arranged lower than the straight rails and intersection connectors.

Distances between the respective neighboring auxiliary rails may be the same.

A distance between the auxiliary rails may be smaller than a distance between the straight rails and between the intersection connectors.

The mover may include a first mover located at a front side thereof, and a second mover located behind the first mover to move on the railway together with the first mover, and the auxiliary mover may include a first auxiliary mover coupled to the first mover and arranged in an opposite direction of the second mover, and a second auxiliary mover coupled to the second mover and arranged in an opposite direction of the first mover.

The first mover and second mover may be connected to each other via magnets.

The first mover and second mover may be rotatably coupled to an upper side of the gripper respectively.

The mover may include a traveling guide wheel mounted at the bottom thereof to prevent the mover from deviating from the railway.

In accordance with example embodiments, an intersection navigation system may include a railway having an intersection and a hoist unit to move on the railway, the intersection and the hoist unit respectively including an intersection auxiliary structure to assist the hoist unit to smoothly pass the intersection.

The intersection auxiliary structure may include an auxiliary rail formed at the intersection, and an auxiliary mover arranged in a movement direction of the hoist unit.

The hoist unit may include a gripper to grip an article, and a mover coupled to the gripper so as to move along the railway, the mover may include a mover frame defining a framework of the mover, and a driving wheel coupled to the mover frame so as to drive the mover, and the auxiliary mover may include an auxiliary mover frame defining a framework of the auxiliary mover, and an auxiliary wheel coupled to the auxiliary mover frame so as to be rotated in contact with the auxiliary rail.

Upon passage of the intersection, the driving wheel may be kept in contact with the intersection connector when the auxiliary wheel is spaced apart from the auxiliary rail, and may be spaced apart from the intersection connector when the auxiliary wheel comes into contact with the auxiliary rail.

BRIEF DESCRIPTION OF THE DRAWINGS

Example embodiments will become apparent and more readily appreciated from the following description taken in conjunction with the accompanying drawings of which.

DETAILED DESCRIPTION

Figure 1:
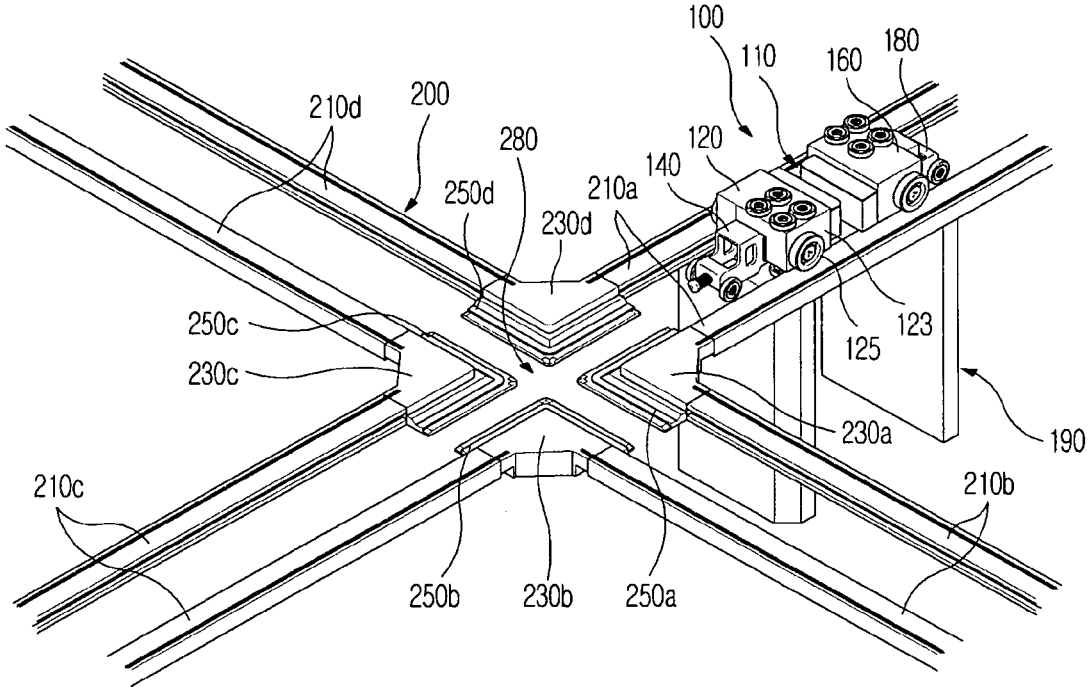
FIG. 1 is a perspective view of an intersection navigation system according to example embodiments.

Example embodiments will now be described more fully with reference to the accompanying drawings, in which example embodiments are shown. The invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, the sizes of components may be exaggerated for clarity.

It will be understood that when an element or layer is referred to as being "on", "connected to", or "coupled to" another element or layer, it can be directly on, connected to, or coupled to the other element or layer or intervening elements or layers that may be present. In contrast, when an element is referred to as being "directly on", "directly connected to", or "directly coupled to" another element or layer, there are no intervening elements or layers present. As used herein, the term "and/or" includes any and all combinations of one or more of the associated listed items.

It will be understood that, although the terms first, second, etc. may be used herein to describe various elements, components, regions, layers, and/or sections, these elements, components, regions, layers, and/or sections should not be limited by these terms. These terms are only used to distinguish one element, component, region, layer, and/or section from another element, component, region, layer, and/or section. Thus, a first element, component, region, layer, or section discussed below could be termed a second element, component, region, layer, or section without departing from the teachings of example embodiments.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises", "comprising", "includes" and/or "including," if used herein, specify the presence of stated features, integers, steps, operations, elements and/or components, but do not preclude the presence or addition of one or more other features, integers, steps, operations, elements, components and/or groups thereof.

Embodiments described herein will refer to plan views and/or cross-sectional views by way of ideal schematic views. Accordingly, the views may be modified depending on manufacturing technologies and/or tolerances. Therefore, example embodiments are not limited to those shown in the views, but include modifications in configuration formed on the basis of manufacturing processes. Therefore, regions exemplified in figures have schematic properties and shapes of regions shown in figures exemplify specific shapes or regions of elements, and do not limit example embodiments.

Reference will now be made in detail to example embodiments, examples of which are illustrated in the accompanying drawings, wherein like reference numerals refer to like elements throughout.

Figure 2:
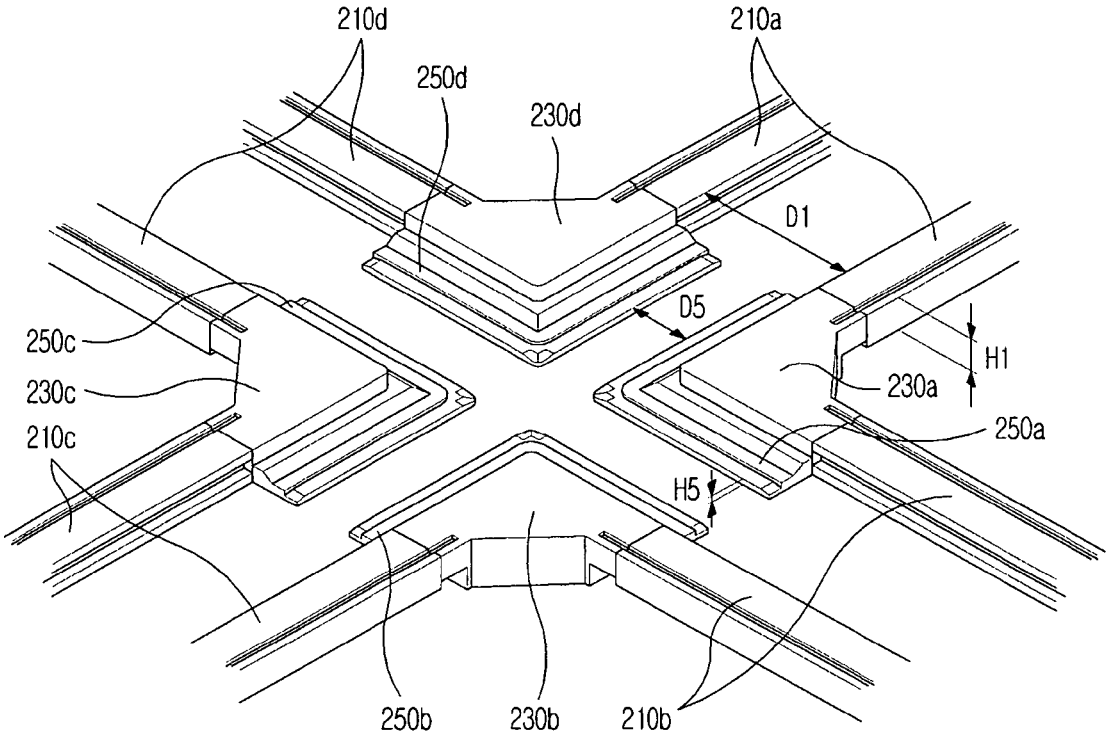
FIG. 2 is an enlarged perspective view of an intersection.
Figure 3:
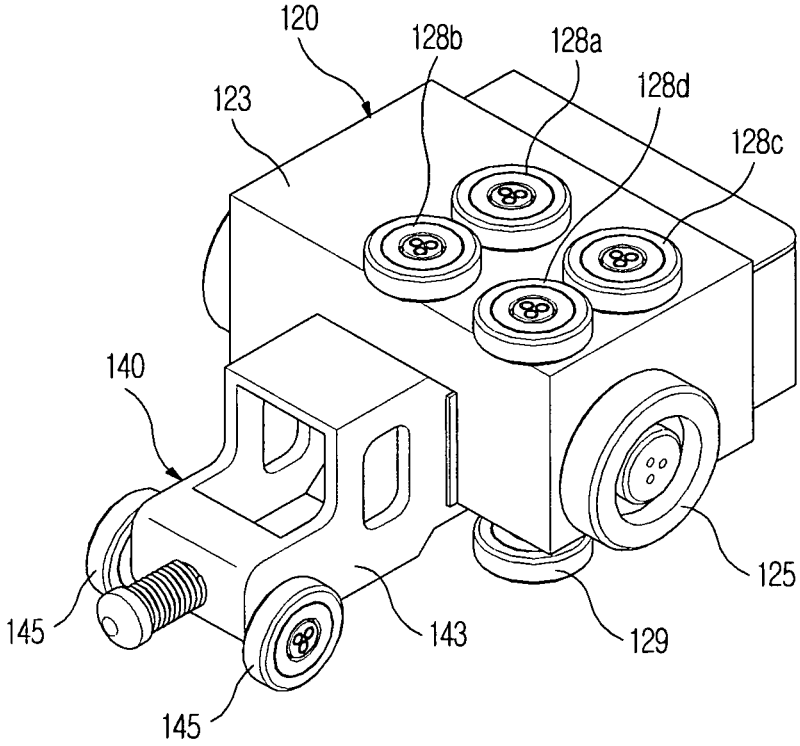
FIG. 3 is a perspective view of a mover of a hoist unit.
Figure 4:
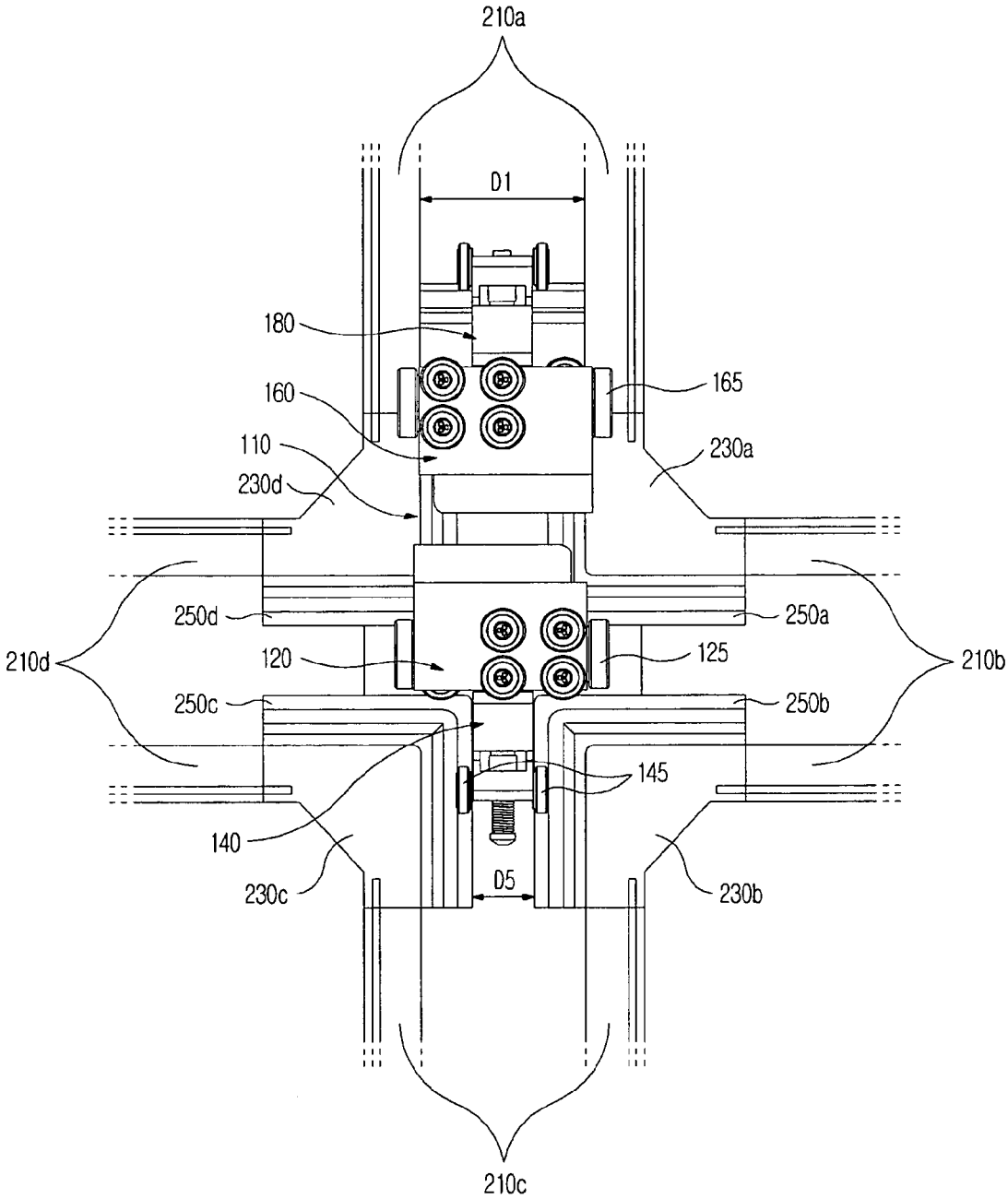
FIG. 4 is a plan view illustrating a state in which the hoist unit is passing the intersection.
Figure 5:
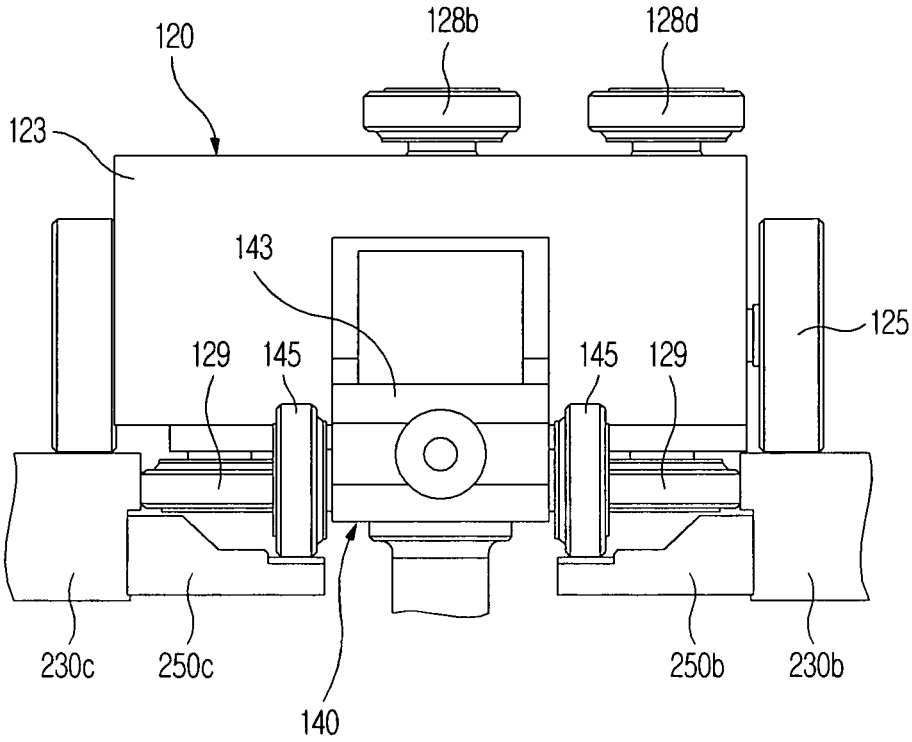
FIG. 5 is a front view illustrating the state in which the hoist unit is passing the intersection.
Figure 6:
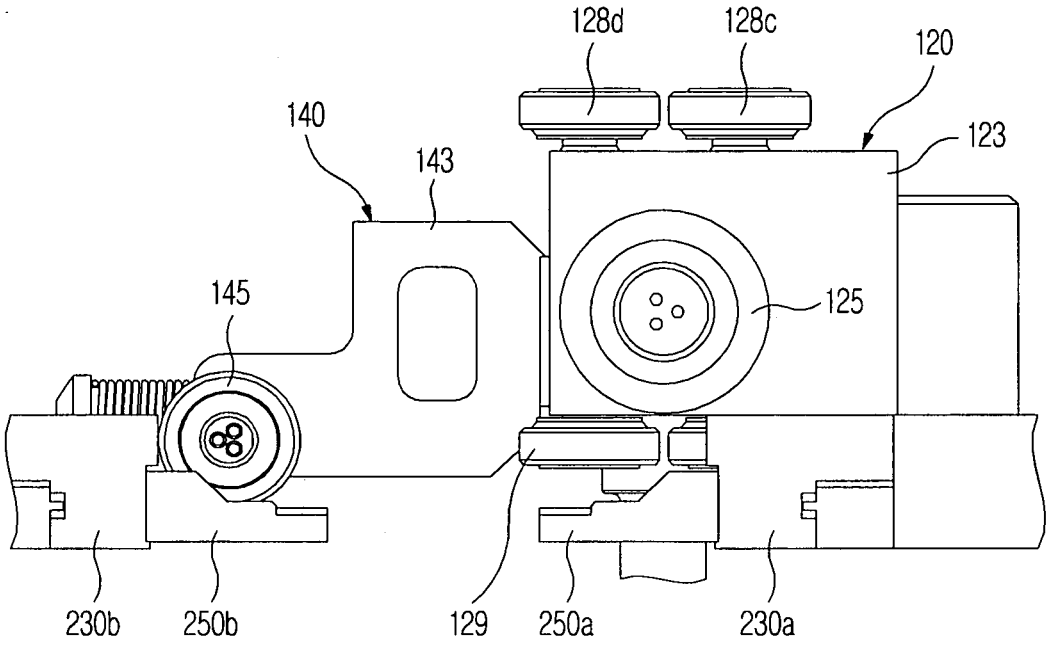
FIG. 6 is a side view illustrating the state in which the hoist unit is passing the intersection.

FIG. 1 is a perspective view of an intersection navigation system according to example embodiments, FIG. 2 is an enlarged perspective view of an intersection, FIG. 3 is a perspective view of a mover of a hoist unit, FIG. 4 is a plan view illustrating a state in which the hoist unit is passing the intersection, FIG. 5 is a front view illustrating the state in which the hoist unit is passing the intersection, and FIG. 6 is a side view illustrating the state in which the hoist unit is passing the intersection.

As shown in FIGS. 1 to 3, the intersection navigation system according to example embodiments includes a hoist unit 100 to transport an article, and a railway 200 having an intersection 280, on which the hoist unit 100 moves.

As shown in FIGS. 1 and 2, the railway 200 may include straight rails 210*a*, 210*b*, 210*c*, and 210*d* to allow rectilinear traveling of the hoist unit 100, intersection connectors 230*a*, 230*b*, 230*c*, and 230*d* to connect the straight rails 210*a*, 210*b*, 210*c*, and 210*d* with one another at the intersection 280, and auxiliary rails 250*a*, 250*b*, 250*c*, and 250*d* arranged inside the respective intersection connectors 230*a*, 230*b*, 230*c*, and 230*d*.

The railway 200 may be mounted to the ceiling of a predetermined space.

The hoist unit 100 may travel on the straight rails 210*a*, 210*b*, 210*c*, and 210*d* of the railway 200 at ordinary times. As will be described in more detail hereinafter, the hoist unit 100 may move forward or rearward on the straight rails 210*a*, 210*b*, 210*c*, and 210*d* by rotation of driving wheels 125 of a mover 110 provided in the hoist unit 100.

The straight rails may include pairs of straight rails 210*a*, 210*b*, 210*c*, and 210*d*, and a distance D1 between each pair of the straight rails 210*a*, 210*b*, 210*c*, or 210*d* may be determined to allow the driving wheels 125 of the mover 110 of the hoist unit 100 to come into rotatable contact with the corresponding rails.

The straight rails 210*a*, 210*b*, 210*c*, and 210*d* may be connected to one another at the intersection 280 by use of the intersection connectors 230*a*, 230*b*, 230*c*, and 230*d*. In addition to connecting the straight rails 210*a*, 210*b*, 210*c*, and 210*d* to one another, the intersection connectors 230*a*, 230*b*, 230*c*, and 230*d* may serve not only to maintain a framework of the railway 200, but also as an object to which the auxiliary rails 250*a*, 250*b*, 250*c*, and 250*d* that will be described hereinafter may be coupled.

The intersection connectors 230*a*, 230*b*, 230*c*, and 230*d* may have the same height as a height H1 of the straight rails 210*a*, 210*b*, 210*c*, and 210*d*. For example, top surfaces of the intersection connectors 230*a*, 230*b*, 230*c*, and 230*d* may have the same elevation as top surfaces of the straight rails 210*a*, 210*b*, 210*c*, and 210*d*. Also, the respective neighboring intersection connectors 230*a*, 230*b*, 230*c*, and 230*d* have the same distance as the distance D1 between each pair of the respective straight rails 210*a*, 210*b*, 210*c*, or 210*d*.

This is because the intersection connectors 230*a*, 230*b*, 230*c*, and 230*d* may also provide a space for passage of the hoist unit 100, in the same manner as the straight rails 210*a*, 210*b*, 210*c*, and 210*d*.

The auxiliary rails 250*a*, 250*b*, 250*c*, and 250*d* may be coupled to inner sides of the intersection connectors 230*a*, 230*b*, 230*c*, and 230*d*. The auxiliary rails 250*a*, 250*b*, 250*c*, and 250*d* may provide a space, through which auxiliary movers 140 and 180 of the hoist unit 100 that will be described hereinafter pass in contact with the auxiliary rails 250*a*, 250*b*, 250*c*, and 250*d* when the hoist unit 100 passes the intersection 280.

A height H5 of the auxiliary rails 250*a*, 250*b*, 250*c*, and 250*d* may be lower than the height H1 of the straight rails 210*a*, 210*b*, 210*c*, and 210*d* and the intersection connectors 230*a*, 230*b*, 230*c*, and 230*d*. For example, top surfaces of the auxiliary rails 250*a*, 250*b*, 250*c*, and 250*d* may have elevations lower than elevations of top surfaces of the straight rails 210*a*, 210*b*, 210*c*, and 210*d*. A distance D5 between the respective neighboring auxiliary rails 250*a*, 250*b*, 250*c*, and 250*d* may be narrower than the distance D1 between each pair of the respective straight rails 210*a*, 210*b*, 210*c*, or 210*d* and between the respective neighboring intersection connectors 230*a*, 230*b*, 230*c*, and 230*d*.

The respective neighboring auxiliary rails 250*a*, 250*b*, 250*c*, and 250*d* may have the same distance D5.

The above-described configuration is devised to allow the hoist unit 100 to easily pass the intersection 280. The passage operation of the hoist unit 100 through the intersection 280 will be described hereinafter in detail.

As shown in FIGS. 1 to 3, the hoist unit 100 may include a gripper 190 to grip the article and the mover 110 to move along the railway 200.

The gripper 190 may serve to lift or lower the article. The gripper 190 may contain downwardly extending grip pieces (not shown) therein. The grip pieces may act to lift the article by gripping it and then, to release the gripped article when the hoist unit 100 reaches a target position.

The mover 110 may be coupled to the top of the gripper 190. The mover 110 may include a first mover 120 located in a front portion thereof, and a second mover 160 located behind the first mover 120 to travel on the railway 200 together with the first mover 120.

The first auxiliary mover 140 may be coupled to a front surface of the first mover 120, and the second auxiliary mover 180 may be coupled to a rear surface of the second mover 160.

The first mover 120 and the first auxiliary mover 140 may have approximately the same configuration as the second mover 160 and the second auxiliary mover 180 except for an orientation thereof and therefore, the following description is focused on the first mover 120 and the first auxiliary mover 140.

The first mover 120 may include a first mover frame 123 defining a body frame of the first mover 120, and first driving wheels 125 coupled to the first mover frame 123 to drive the first mover 120.

The first driving wheels 125 may be driven by a drive source that is mounted to the first mover frame 123. A motor (not shown) may be used as the drive source.

A plurality of divergence wheels 128*a*, 128*b*, 128*c*, and 128*d* may be coupled to an upper surface of the first mover frame 123. The divergence wheels 128*a*, 128*b*, 128*c*, and 128*d* may have variable horizontal positions in response to operation of an electromagnetic switch. When the divergence wheels 128*a*, 128*b*, 128*c*, and 128*d* come into contact with a branch rail, the positions of the divergence wheels 128*a*, 128*b*, 128*c*, and 128*d* vary horizontally, causing the first mover 120 to move in a diverged direction. This technology related to changing a traveling direction toward the branch rail is known in the conventional art and therefore, a detailed description thereof will be omitted.

A traveling guide wheel 129 may be coupled to a lower surface of the first mover frame 123. The traveling guide wheel 129 may be shaped to be inserted in the distance D1 between each pair of the respective straight rails 210*a*, 210*b*, 210*c*, or 210*d* and between the respective neighboring intersection connectors 230*a*, 230*b*, 230*c*, and 230*d*. The traveling guide wheel 129 serves to guide traveling of the first mover 120 so as to prevent or retard the first mover 120 from deviating from the railway 200.

The first auxiliary mover 140 may be integrally formed with a front surface of the first mover frame 123. The first auxiliary mover 140 may include a first auxiliary mover frame 143 defining a framework of the first auxiliary mover 140, and first auxiliary wheels 145 rotatably coupled to the first auxiliary mover frame 143.

A distance between the first auxiliary wheels 145 may be narrower than the distance D1 between each pair of the respective straight rails 210*a*, 210*b*, 210*c*, or 210*d* and between the neighboring intersection connectors 230*a*, 230*b*, 230*c*, and 230*d*. Also, the first auxiliary wheels 145 may have a lower rotation center than that of the first driving wheels 125. This configuration serves to allow the first auxiliary wheels 145 to move on the auxiliary rails 250*a*, 250*b*, 250*c*, and 250*d*.

The principle of the mover 110 crossing the intersection 280 will be described hereinafter with reference to FIGS. 4 to 6.

Assuming that the first mover 120 travels to cross the intersection 280 via rotation of the first driving wheels 125 without the first auxiliary mover 140, the distance D1 between each pair of the straight rails 210*a*, 210*b*, 210*c*, or 210*d* and between the neighboring intersection connectors

230*a*, 230*b*, 230*c*, and 230*d* may essentially cause the first mover 120 to fall into the intersection 280.

However, providing the first auxiliary mover 140 at the front surface of the first mover 120 results in the arrangement relationship of the first mover 120 and the railway 200 as shown in FIGS. 4 to 6.

The first driving wheels 125 of the first mover 120 may be kept suspended in the air rather than coming into contact with the straight rails 210*a*, 210*b*, 210*c*, and 210*d*. The first auxiliary wheels 145 of the first auxiliary mover 140 may be rotated in contact with the auxiliary rails 250*b* and 250*c*, serving to support the first mover 120 so as to prevent falling of the first mover 120. In example embodiments, as shown in FIG. 6, a distance between a rotation center of the first auxiliary wheel 145 and a rotation center of the first driving wheel 125 is longer than a distance between the auxiliary rail 250*b* and the intersection connector 230*a* facing to the auxiliary rail 250*b*.

Even if drive force of the first driving wheels 125 is not transmitted to the railway 200, second driving wheels 165 of the second mover 160 are driven, causing the entire mover 110 to continuously move in a movement direction thereof.

The auxiliary movers 140 and 180 may serve to prevent falling of the mover 110 at the intersection 280. Specifically, the auxiliary movers 140 and 180 cause partial regions of the mover 110 to temporarily come into contact with and be supported by the auxiliary rails 250*a*, 250*b*, 250*c*, and 250*d* when the mover 110 passes the intersection 280.

Hereinafter, the operation sequence of the mover 110 of the hoist unit 100 when the hoist unit 100 passes the intersection 280 according to example embodiments will be described.

FIGS. 7A to 7D are views illustrating the operation sequence of the hoist unit passing the intersection.

Figure 7A:
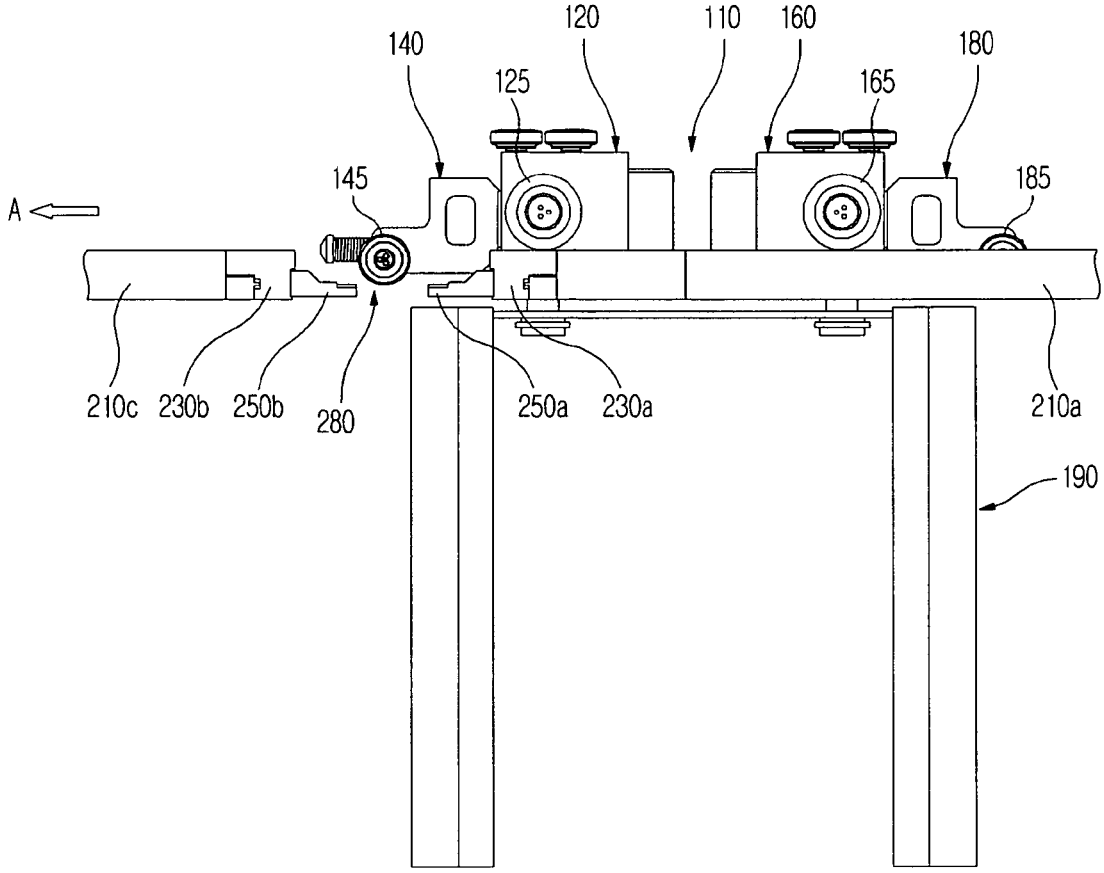
FIGS. 7A to 7D are views illustrating an operation sequence of the hoist unit when the hoist unit passes the intersection.

As shown in FIG. 7A, the hoist unit 100 may move in a direction "A" to reach the intersection 280. At this point, the first auxiliary wheel 145 of the first auxiliary mover 140 may be located at the center of the intersection 280 and may be kept suspended in the air. In this configuration, the first driving wheel 125 of the first mover 120 may be supported on the intersection connector 230*a* located downstream of the intersection 280 (FIG. 7A).

Figure 7B:
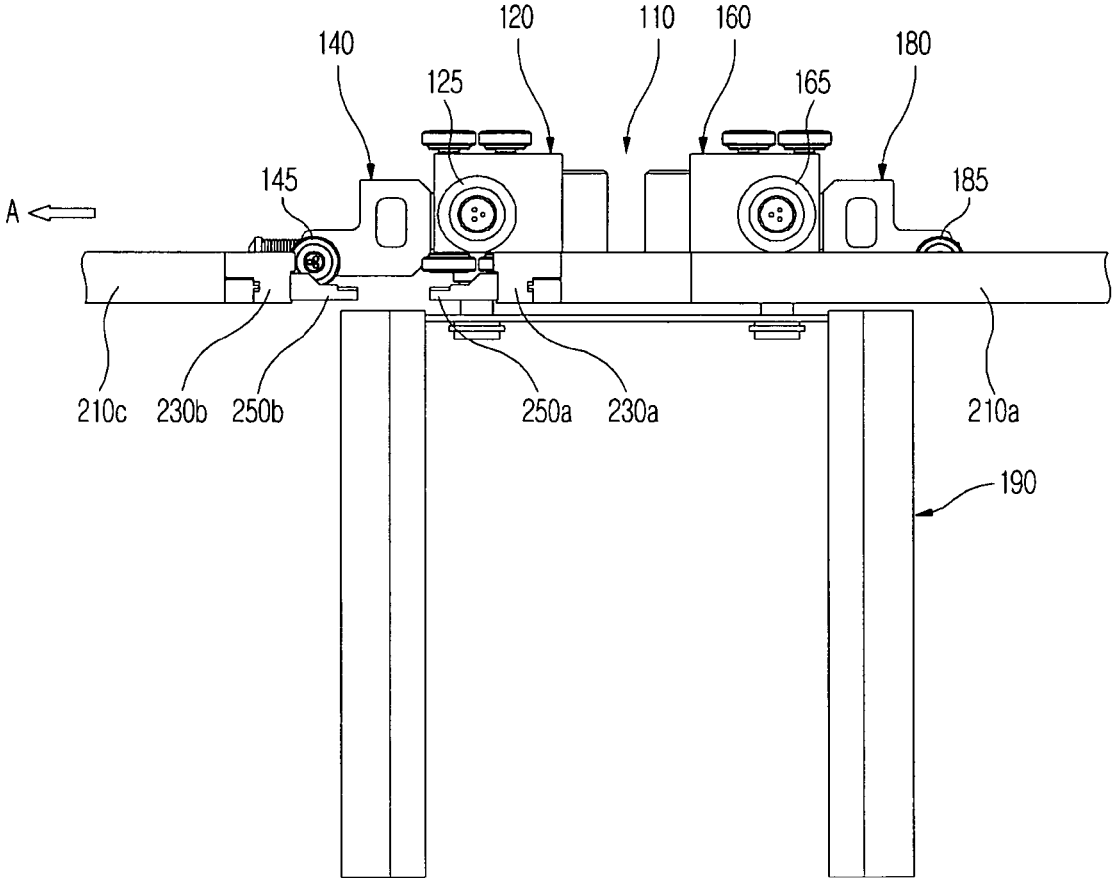

The hoist unit 100 may further move in the direction "A" as the first driving wheel 125 and the second driving wheel 165 are continuously driven and the first auxiliary wheel 145 of the first auxiliary wheel 140 may be rotated in contact with the auxiliary rail 250*b* located upstream of the intersection 280. In this configuration, the first driving wheel 125 of the first mover 120 may be suspended in the air rather than coming into contact with the intersection connector 230*a* (FIG. 7B).

Figure 7C:
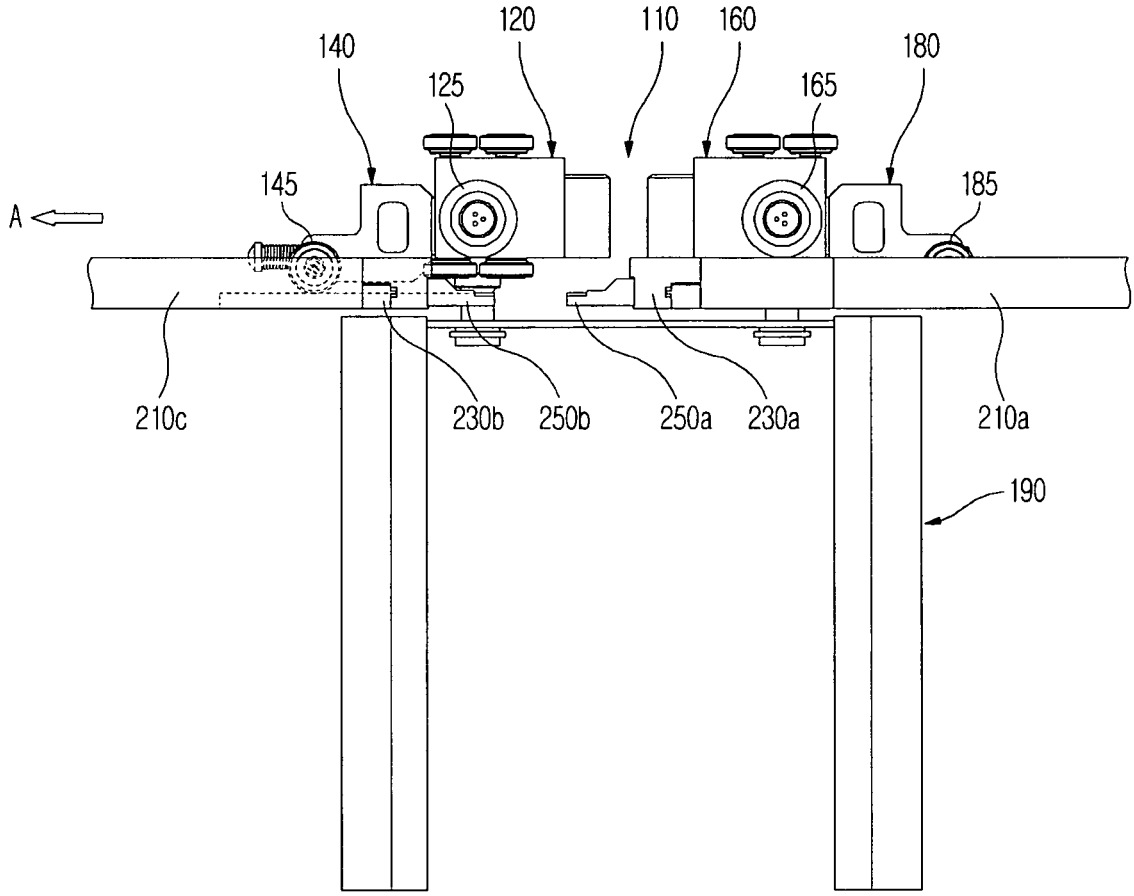

Even in the suspended state of the first driving wheel 125, drive force of the second driving wheel 165 may be continuously transferred to the straight rail 210*a* located downstream of the intersection 280, allowing the hoist unit 100 to continuously move in the direction "A" (FIG. 7C).

Figure 7D:
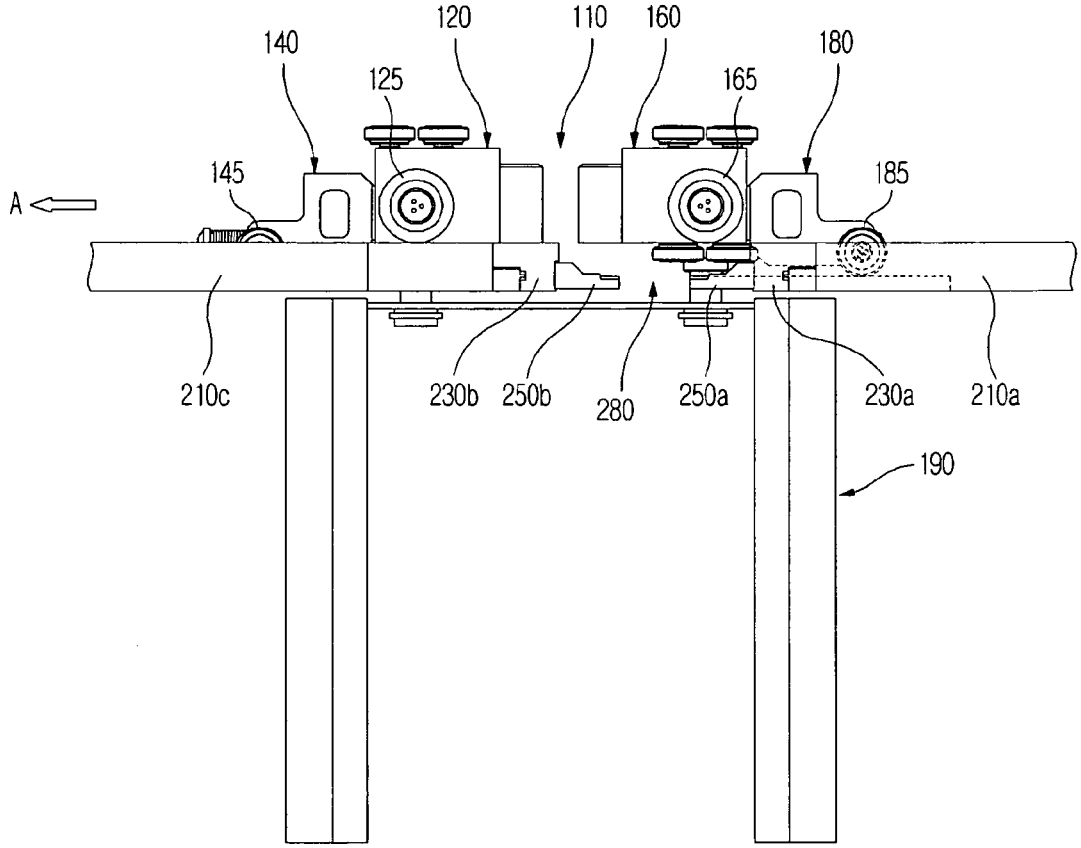

The hoist unit 100 may further move in the direction "A" under the driving force provided by the second driving wheel 165 and the first mover 120 may completely cross the intersection 280. Accordingly, the first driving wheel 125 may be rotated in contact with the straight rail 210*c* located upstream of the intersection 280. Subsequently, the second mover 160 may cross the intersection 280. In this case, the second driving wheel 165 may be suspended in the air at the center of the intersection 280, and a second auxiliary wheel 185 may come into contact with the auxiliary rail 250*a* located downstream of the intersection 280, so as to support the second mover 160 (FIG. 7D).

Thereafter, similar to the first mover 120 crossing the intersection 280, the second mover 160 may continuously moves in the direction "A" so that the second driving wheel 165 comes into contact with the straight rail 210*c*. In this way, the hoist unit 100 completely crosses the intersection 280.

Figure 8A:
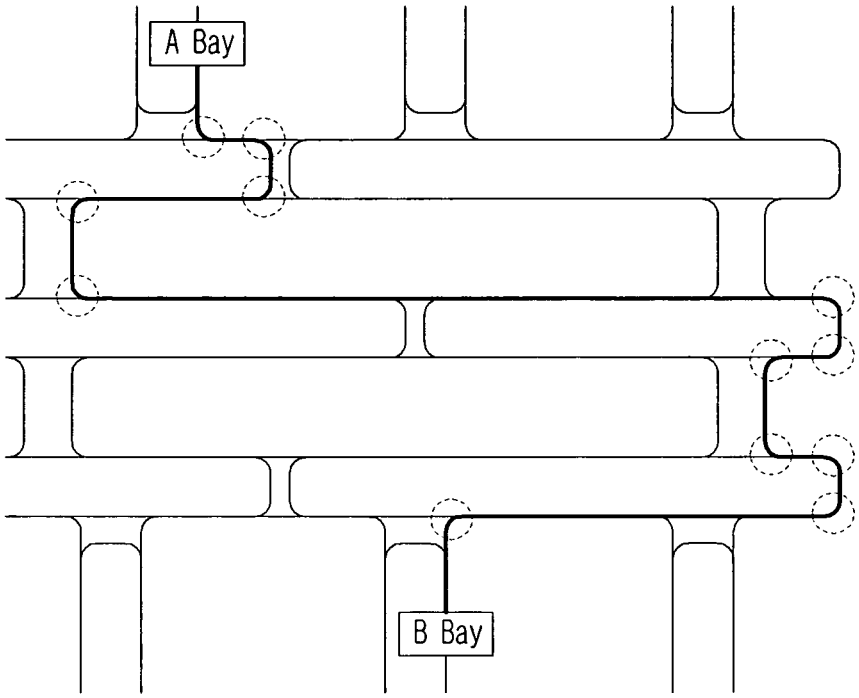
FIG. 8A is a schematic view illustrating a movement path of the hoist unit in a situation wherein the hoist unit may not cross the intersection according to the conventional art.
Figure 8B:
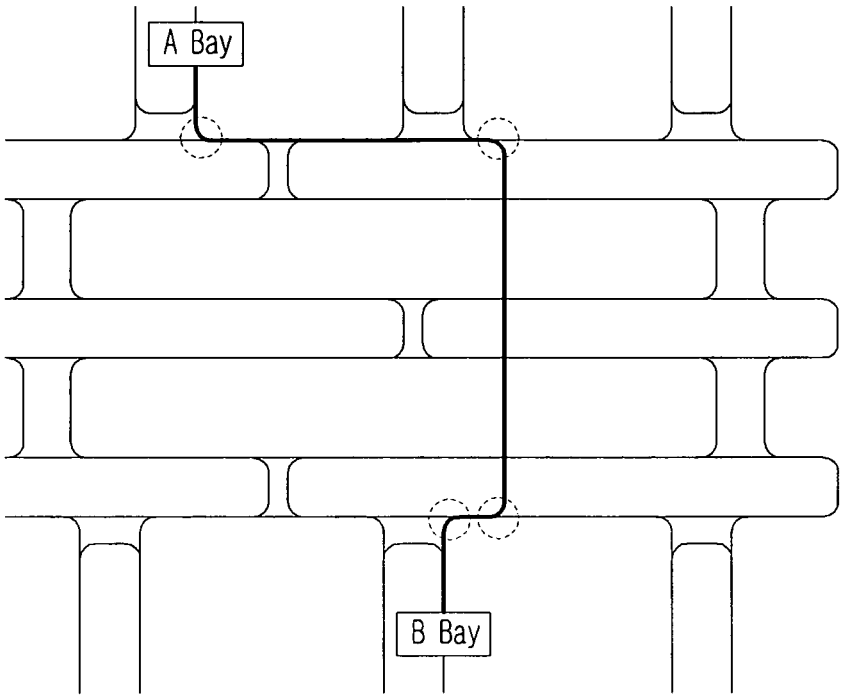
FIG. 8B is a schematic view illustrating a movement path of the hoist unit when the hoist unit crosses the intersection according to example embodiments.

FIG. 8A is a schematic view illustrating a movement path of a hoist unit in a situation wherein the hoist unit may not cross the intersection according to the conventional art, and FIG. 8B is a schematic view illustrating a movement path of a hoist unit when the hoist unit crosses the intersection according to example embodiments.

As shown in FIG. 8A, when it is attempted to move the hoist unit 100 from "A Bay" to "B Bay", the conventional art has allowed only that the hoist unit 100 changes a movement direction thereof to a diverged direction. This results in a complicated lengthy movement path.

However, as shown in FIG. 8B, if the hoist unit 100 crosses the intersection 280, the movement path of the hoist unit 100 may be remarkably simplified and shortened as compared to the conventional art.

That is, time required to reach a target place may be reduced, and highly effective layout of the railway may be accomplished.

Hereinafter, a hoist unit according to example embodiments will be described. A description of the same configurations as the previously described embodiment will be omitted hereinafter.

Figure 9:
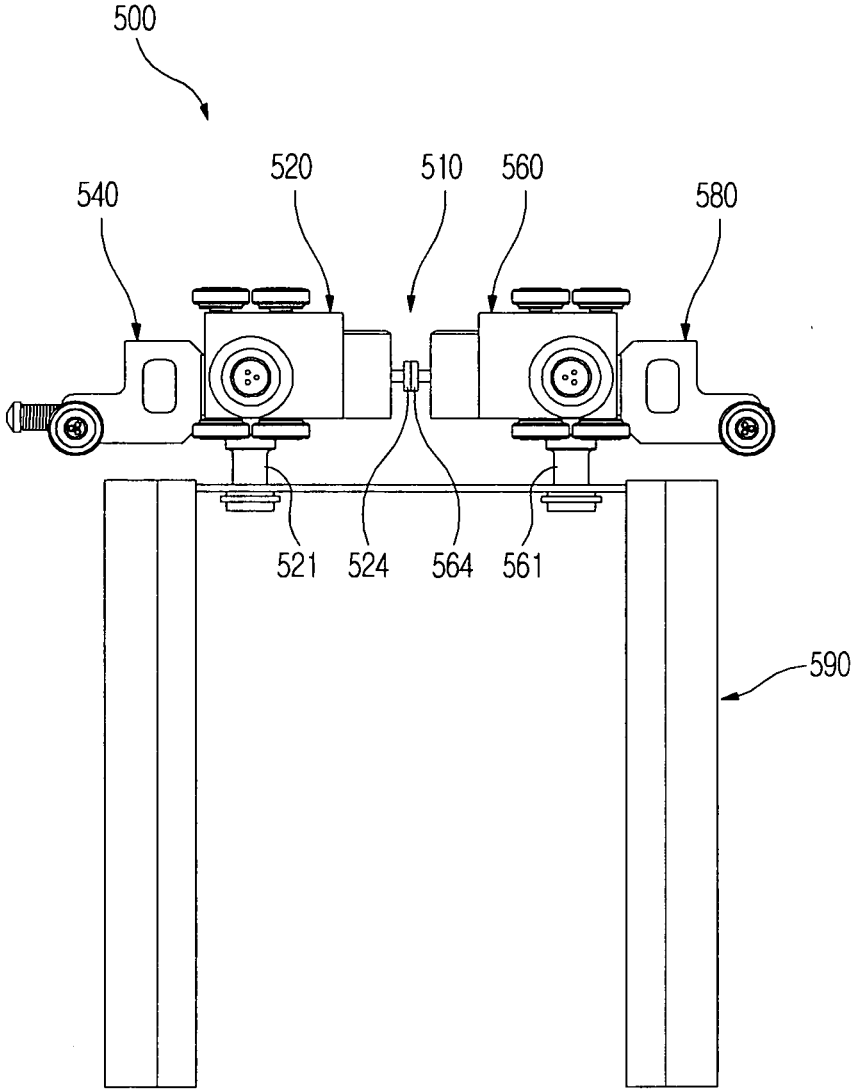
FIG. 9 is a side view illustrating a hoist unit according to example embodiments.

FIG. 9 is a side view illustrating a hoist unit according to example embodiments.

The hoist unit 500 according to the embodiment of FIG. 9 is identical to the hoist unit 100 of the previously described embodiment except for the provision of magnets 524 and 564.

The mover 510 according to example embodiments may include a first mover 520 and a second mover 560. A first auxiliary mover 540 may be attached to the first mover 520 and a second auxiliary mover 580 may be attached to the second mover 560. In example embodiments, the first mover 520 and the second mover 560 may be configured as separate components. The first mover 520 and the second mover 560 may be rotatably coupled to a gripper 590 via shafts 521 and 561. Accordingly, when the first mover 520 moves, any one of the first mover 520 and the second mover may be unbalanced or deviated from a movement direction thereof. In particular, this may easily occur when the hoist unit 500 crosses the intersection 280 or is moved to a diverged direction.

However, when the magnets 524 and 564 are attached respectively to one end of the first mover 520 and one end of the second mover 560 so as to magnetically attract each other, each of the first mover 520 and the second mover 560 may maintain balance thereof even if the other one is unbalanced or is deviated from the movement direction thereof. This may result in enhanced traveling efficiency of the hoist unit 500.

As is apparent from the above description, in an intersection navigation system according to example embodiments, providing a railway with auxiliary rails and a mover of a hoist unit with auxiliary movers may allow the hoist unit to pass an intersection.

Further, with easy intersection passage of the hoist unit, the hoist unit may move using the shortest path from a starting position to a target position.

Although example embodiments have been shown and described, it would be appreciated by those skilled in the art that changes may be made in example embodiments without departing from the principles and spirit of the invention, the scope of which is defined in the claims and their equivalents.

What is claimed is:

1. An intersection navigation system comprising:

a hoist unit including a mover and an auxiliary mover, the mover having driving wheels and the auxiliary mover having auxiliary wheels;

a railway on which the mover moves, the railway including a plurality of straight rails and an intersection; and auxiliary rails on which the auxiliary mover moves being arranged at the intersection of the railway;

wherein four or more intersection connectors connect the plurality of straight rails to one another and each of the four or more intersection connectors are separately located at each of the four or more corners of the intersection, and wherein the auxiliary mover is configured to prevent the hoist unit from falling when the hoist unit passes through the intersection.

2. The system according to claim 1, wherein the plurality of straight rails are configured to permit rectilinear traveling of the hoist unit, the auxiliary rails are on inner sides of each of the four or more intersection connectors.

3. The system according to claim 1, wherein the hoist unit further includes a gripper coupled to the mover, wherein the gripper grips an article and wherein the mover moves the hoist unit along the railway, and the auxiliary mover is arranged in a movement direction of the mover.

4. The system according to claim 3, wherein the mover includes a mover frame, the driving wheels being coupled to the mover frame to drive the mover, and the auxiliary mover includes an auxiliary mover frame, the auxiliary wheels being coupled to the auxiliary mover frame so as to be rotated in contact with the auxiliary rails.

5. The system according to claim 4, wherein a distance between a rotation center of the auxiliary wheels and a rotation center of the driving wheels is greater than a distance between each auxiliary rail and one of the four or more intersection connectors facing the auxiliary rail.

6. The system according to claim 5, wherein a distance between the auxiliary wheels is smaller than a distance between neighboring plurality of straight rails and a distance between neighboring one of the four or more intersection connectors.

7. The system according to claim 2, wherein the auxiliary rails are lower than the four or more intersection connectors.

8. The system according to claim 7, wherein the auxiliary wheels are arranged lower than the plurality of straight rails and the four or more intersection connectors.

9. The system according to claim 2, wherein distances between neighboring auxiliary rails are the same.

10. The system according to claim 2, wherein a distance between the auxiliary rails is smaller than a distance between the plurality of straight rails and a distance between the four or more intersection connectors.

11. The system according to claim 4, wherein the mover includes a first mover at a front side thereof, and a second mover behind the first mover to move on the railway together with the first mover, and the auxiliary mover includes a first auxiliary mover coupled to the first mover and arranged in an opposite direction of the second mover, and a second auxiliary mover coupled to the second mover and arranged in an opposite direction of the first mover.

12. The system according to claim 11, wherein the first mover and the second mover are connected to each other via magnets.

13. The system according to claim 11, wherein the first mover and the second mover are rotatably coupled to an upper side of the gripper.

14. The system according to claim 4, wherein the mover includes a traveling guide wheel at the bottom thereof configured to prevent the mover from deviating from the railway.

15. An intersection navigation system comprising:

a hoist unit including a mover and an auxiliary mover, the mover having driving wheels and the auxiliary mover having auxiliary wheels;

a railway on which the mover moves, the railway including an intersection; and auxiliary rails on which the auxiliary mover moves being arranged at the intersection of the railway;

wherein the auxiliary mover is configured to prevent the hoist unit from falling when the hoist unit passes through the intersection, the mover includes a first mover at a front side thereof, and a second mover behind the first mover to move on the railway together with the first mover, and the auxiliary mover includes a first auxiliary mover coupled to the first mover and arranged in an opposite direction of the second mover, and a second auxiliary mover coupled to the second mover and arranged in an opposite direction of the first mover, wherein the first mover and the second mover are connected to each other via magnets.

* * * * *